US006910426B2

(12) United States Patent
Krishnaswami

(10) Patent No.: US 6,910,426 B2
(45) Date of Patent: Jun. 28, 2005

(54) CONTROL ARM SYSTEM FOR STEERING BOGIE WHEELS AND AXLES

(75) Inventor: Balasubramanyan Ananthanarayanan Krishnaswami, Kolkata (IN)

(73) Assignee: Besco Limited, Kolkata (IN)

( * ) Notice: Subject to any disclaimer, the term of this patent is extended or adjusted under 35 U.S.C. 154(b) by 0 days.

(21) Appl. No.: 10/355,047

(22) Filed: Jan. 31, 2003

(65) Prior Publication Data

US 2004/0149161 A1 Aug. 5, 2004

(51) Int. Cl.[7] ..... B61F 5/00
(52) U.S. Cl. ..... 105/167
(58) Field of Search ..... 105/157, 165, 105/168, 167, 182.1, 190.1, 194

(56) References Cited

U.S. PATENT DOCUMENTS 135,614 A * 2/1873 Youmans ..... 105/168
1,003,277 A * 9/1911 Lincoln ..... 105/168
4,003,316 A * 1/1977 Monselle ..... 105/167
4,067,261 A * 1/1978 Scheffel ..... 105/168
4,067,262 A * 1/1978 Scheffel ..... 105/168
4,237,791 A * 12/1980 Jackson et al. ..... 105/168
4,244,297 A * 1/1981 Monselle ..... 105/168
4,428,301 A * 1/1984 Jackson ..... 105/168
4,429,637 A * 2/1984 Jackson et al. ..... 105/168
4,480,553 A * 11/1984 Scheffel ..... 105/167
6,233,806 B1 * 5/2001 Anderson et al. ..... 29/402.03

* cited by examiner

*Primary Examiner*—Mark T. Le
(74) *Attorney, Agent, or Firm*—Venable LLP; Catherine M. Voorhees

(57) ABSTRACT

An improved bogie control arm for steering wheels and axles of bogies comprising of two pairs of C-type control arm made out of rolled steel channel section which has been flared by splitting the web and thereafter welding profile cut steel plates, two pairs of fabricated adapter is connected to said control arm by means of welding or rivetting, the fabricated adapter is provided with rubber spring as primary suspension, the two pairs of 'C'-type control arms are connected to each other by means of cross struts and pins.

7 Claims, 6 Drawing Sheets

NEW WHEEL
1 IN 20 TAPER ACROSS
TREAD

WORN WHEEL
TREAD WORN HOLLOW
WITH REVERSE CURVATURE

CONTROL ARM SYSTEM FOR STEERING BOGIE WHEELS AND AXLES

FIELD OF INVENTION

This invention relates to an outboard bogie control arm and an improved inboard bogie control arm for steering wheels and axles of bogies for Railway wagons and carriages.

Cast steel bogies with three pieces 'H' frame comprising two side frames and a bolster connecting the side frames are very much in use throughout the world railways for carrying wagons with heavy freight and at high speed.

BACKGROUND OF THE INVENTION

This conventional bogie has two pairs of wheels with axles viz a front pair of wheels and a rear pair of wheels for facilitating running of the wagon on rails. The wheels are firmly fitted on axle which rotates together while running and are held in position by the 'H' frame at end of axles through boxes. It is the 'H' frame which plays a major part for the total behaviour of the bogie.

There are disadvantages associated with the existing system of 'H' frame bogies.

One of the main disadvantages associated with the present system of conventional 'H' frame bogies is that when the wheels run on a pair of straight rail tracks, when there is a perfect alignment between the wheel flange and rail head and the wear of the wheel flange and rail head may be minimum.

This in general is not practicable during manufacture. When tolerances are applied the trueness of geometry is affected and wear propensity increases. Also when the wheels negotiate a curved track the wheel flange strikes the rail head at an angle called angle of the attack. Due to continuous rubbing of the wheel flange on rail head both wears very fast.

This phenomenon aggravates further with higher speed and higher haulage load. Since neither the speed nor the haulage loads could be reduced for economic reasons, this wheel wears can not be avoided in conventional bogie wheels and rail heads.

Another disadvantage associated with the present system of conventional 'H' frame bogies is that the bogie frame oscillates continuously and the rubbing faces wear rapidly causing increase in clearances between the 'H' frame and axle boxes of the wheels. Even when the frame is new, due to initial clearances, the conventional bogie tends to become unstable exhibiting a behaviour called 'hunting' at speeds above 50/55 k.m.p.h on straight track. This gets further agravated by a host of other factors like increased clearances, higher speed, higher axle loading, track/car geometry and rail profile.

Yet another disadvantage associated with the present conventional 'H' frame bogies is that the front pair of wheels and the rear pair of wheels being independent of each other and having clearances to play never negotiate the track rail tangentially.

In view of all above disadvantagaes, a fast moving bogie either on Tangent Track or when trying to negotiate a curved track will have its alignment lost because of lozenging effect of 'H' frame. Hence angle of attack, i.e. angle subtended by the wheel flange and rail head shall be very much high. Even in a bogie where the wheels are almost squarely with the frame, the angle of attack is of quite considerable amount.

As a result a conventional bogie is prone to:

a) excessive wheel wear, b) wear of rail head and loss of rail head profile, c) derailment caused by (a) & (b) above.

To overcome these disadvantages various attempt were made to improve the life of the bogie and the safety of operation at high speed. These are briefly described below:

1. Lubrication of rail head for reducing wheel wear and rail wear by automatic spraying of oil at the negotiating curved track.

This has not been found very much productive/effective in view of wheels touching the rails at a very wide angle and at a very high speed and high momentum value.

2. Cross Brace Bogie has been developed to maintain alignment of bogie/truck wheels by providing cross bracings diagonally for meeting wheel alignment or squarity at each diagonally opposite ends of the bogie.

The system suffers from being too fragile for heavy rough work needed for wagons or freight cars moving at high speed over rough track condition. The system definitely requires repeated maintenance. The replacement costs are quite high.

3. A C-Type Cast Steel Steering Arm is a single piece casting connected with the axle box adapter at end of axles. This single piece casting is very heavy and reduces the carrying capacity appreciably to the extent of its self weight. This system requires side lining of the wagon/car for a considerable period for maintenance or over hauling of the steering device or the bogie.

The wagon superstructure is to be fully removed to have access for even general maintenance work required for the Bogie steering arms. Even a localised defect may require total replacement of the arm resulting into added cost. Adapters are connected only on inside lugs resulting into lesser amount of grip on axle journals.

4. C-Type fabricated Mild Steel Steering Arm has so far been designed with welded flat sections involving large amount of weld metal deposition which leads to distortions of the arm after welding. These are rectified by heavy press work which causes internal stresses in the arm as well as in the weld bids. The initial distortion tries to come back due to constant stress and stress during service and the geometry gets lost.

Out of the above four types of improved bogies, the last one namely the 'C-type fabricated mild steel steering arm' has partially improved the performance but for the drawbacks or disadvantages as mentioned.

There are many types of steering bogies which are in service mostly in Meter Gauge and some in the Standard Gauge. The Meter Gauge bogies are known as "Scheffel Cross Anchor Bogie" which run on 1067 mm track gauge. There are other versions of this bogie known as "Barber Radial", "Amsted AR-1" and "Amsted AR2" which are on the 1435 mm track gauge. These bogies have the 'C' Arms only for in-board type of different constructional details.

The present invention is for improved and easy construction of in-board steering mechanism and also newly invented out-board steering mechanism.

There are no steering bogies where the steering device can be retrofitted on the existing bogies in service. This type of steering mechanism of the invention has the ability to render the vendor to retrofitment on the existing bogies. In addition to such retrofitment, the same will additionally accommodate retrofitment of clasp Brake and Bogie Mounted Brake.

SUMMARY OF THE INVENTION

Therefore the main object of the present invention is to propose an improved bogie which when used for high speed run has less wear with increased life and light safety standard.

This invention provides for the control arms device for out-board or in-board application. In all cases scope is given for incorporating clasp brakes or bogie mounted brakes of single shoe type or bogie mounted brakes of clasp brake types.

According to the present invention there is provided an outboard bogie control arm and an improved bogie control arm for steering wheels and axles of bogies for railway wagons and carriages comprising of two pairs of C-type control arms made of mild steel (M.S.) fabrication or cast steel, two fabricated adapters are connected to each control arm by means of welding or rivetting or huck bolt, said fabricated adapter is provided with a rubber spring as a primary suspension, said two pairs of 'C' type control arms are connected to each other by means of cross struts and pins.

The C-arms of both the types of this invention may be fabricated or cast steel.

The nature of the invention, its objective and further advantages residing in the same will be apparent from the following description made with reference to the non-limiting exemplary embodiments of the invention represented in the drawings:

DETAILED DESCRIPTION

Figure 1A:
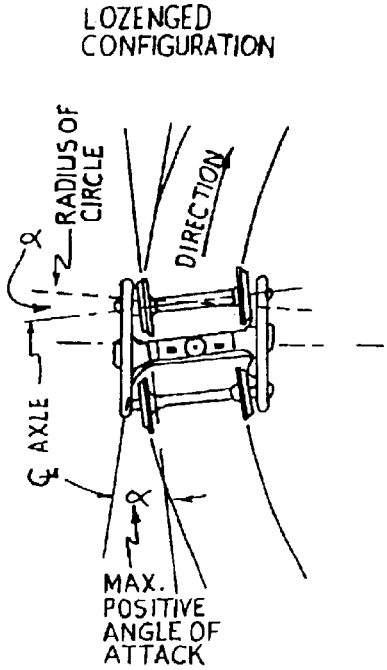
FIG. 1*a* shows the angle of attack of leading wheel in curve-example of maximum positive angle of attack.
Figure 1B:
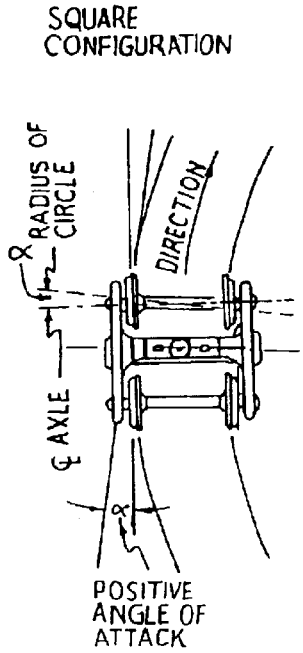
FIG. 1*b* same as FIG.-A but with normal positive angle of attack.
Figure 1C:
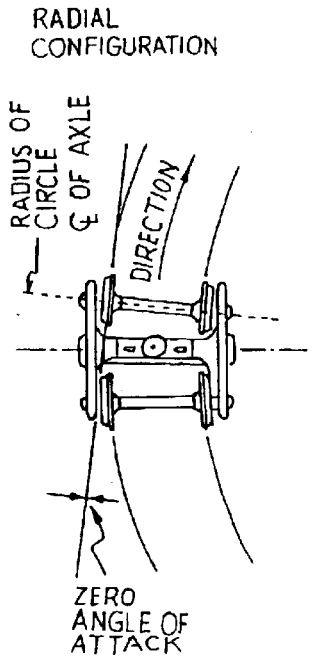
FIG. 1*c* same as FIG.-A but with zero angle of attack.
Figure 1D:
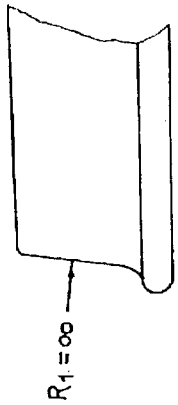
FIG. 1*d* shows the profile of a new wheel 1 to 20 taper across tread.
Figure 1E:
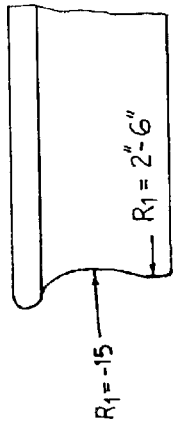
FIG. 1*e* shows a worn wheel tread worn hollow with reverse curvature.

FIGS. 1*a*, 1*b*, 1*c* illustrates three different exemplary angles of attack which has been described earlier. FIGS. 1*d* and 1*e* illustrate tread profile when new and after it has been worn out. The object of the invention is to propose a bogie which improves the angle of attack during negotiating a curve. So worn out of the tread is minimised and the Wagon or freight car with the improved bogie can negotiate the curve at higher speed.

Figure 2:
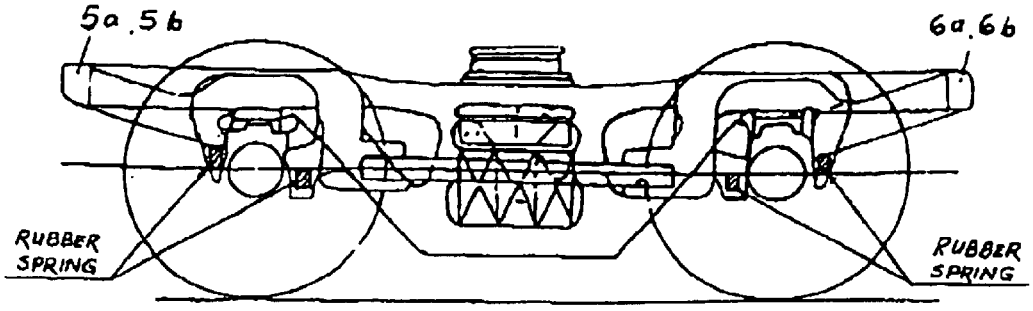
FIG. 2 shows an elevation of the bogie assembly of our invention. This is out-board version.
Figure 3:
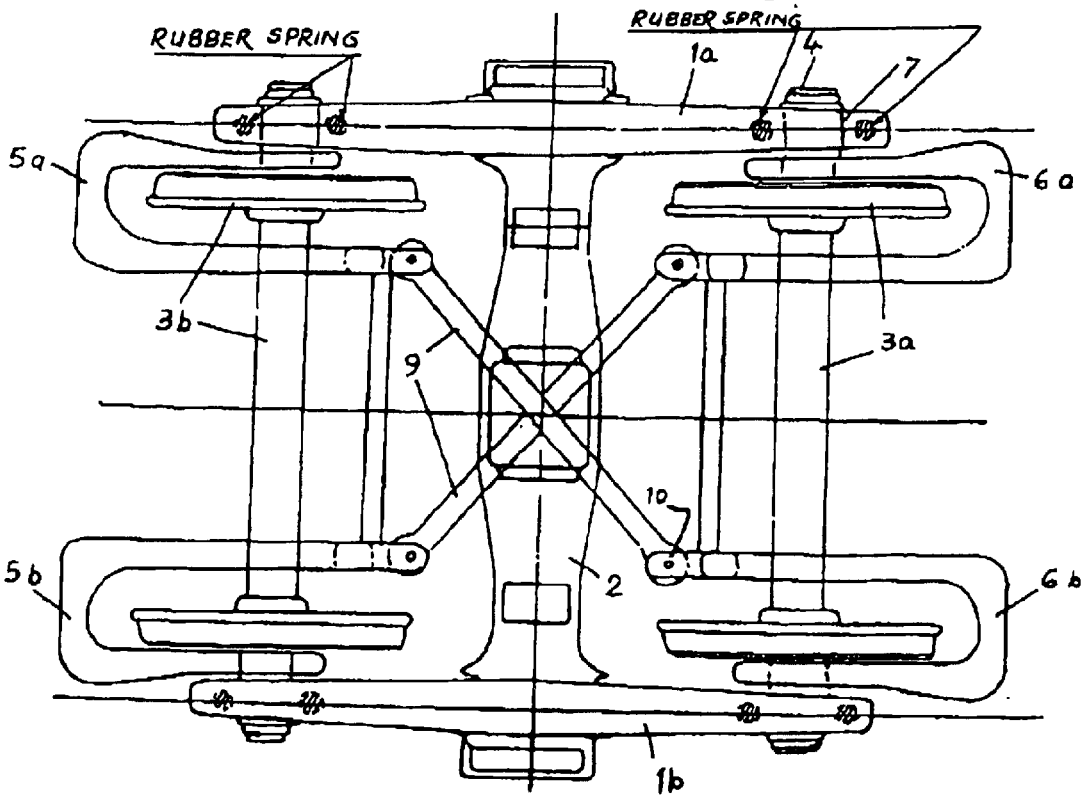
FIG. 3 shows a plan view of the bogie assembly of FIG. 2.
Figure 2A:
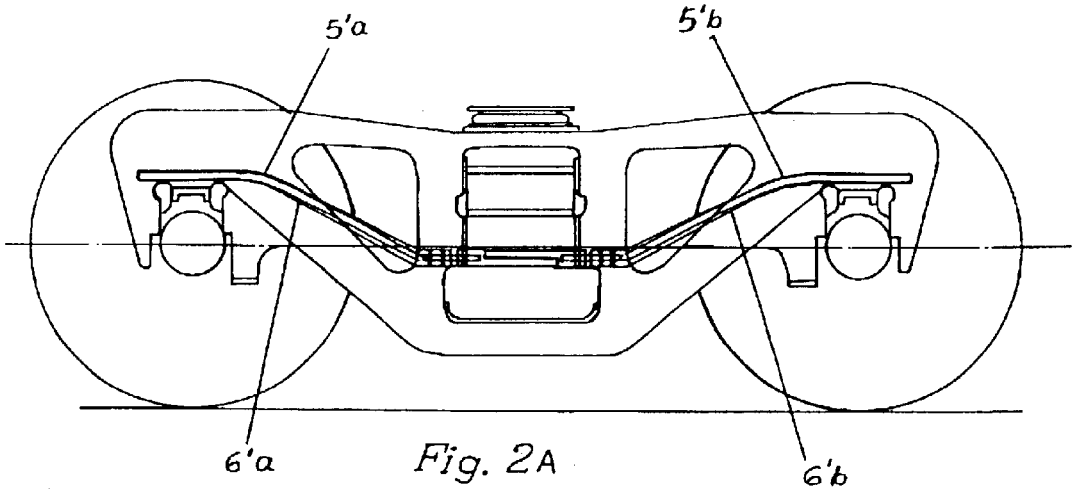
FIG. 2A shows an elevation of the bogie assembly of our invention with an alternative embodiment of the control arm. This is in-board version.
Figure 3A:
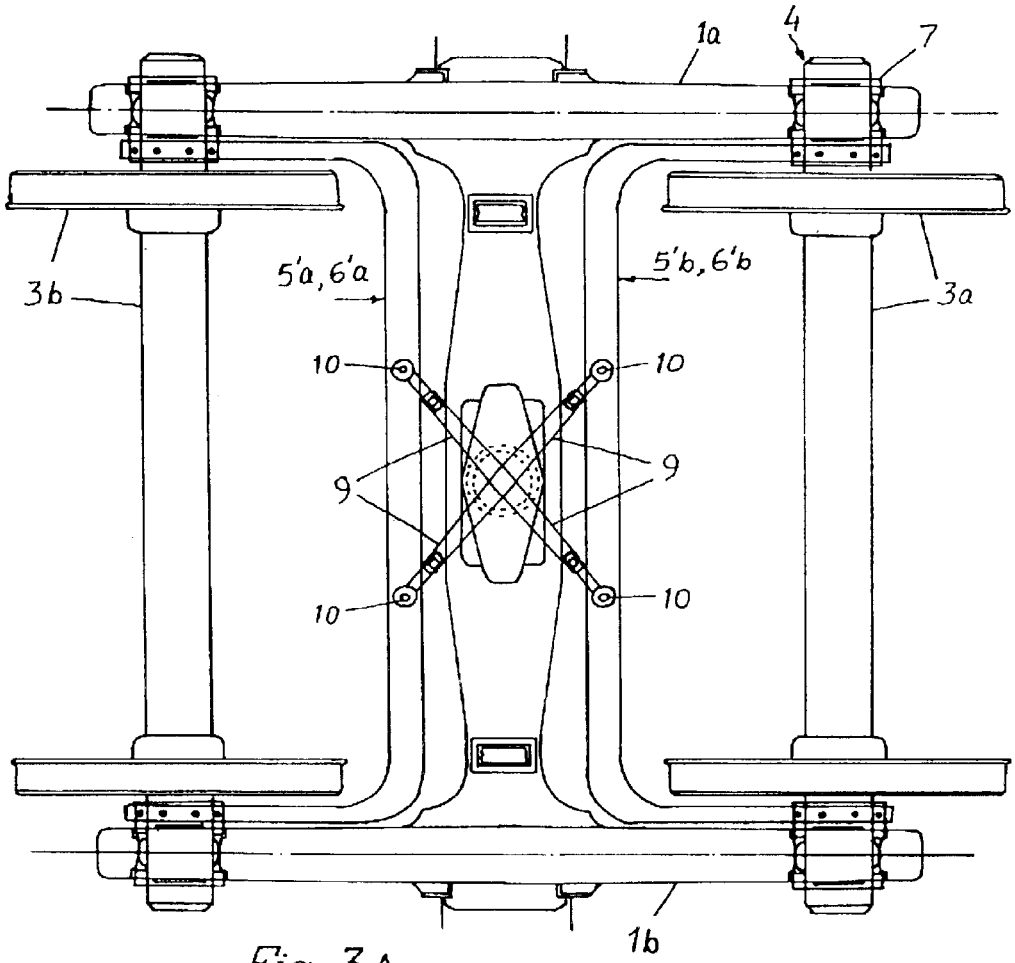
FIG. 3A shows plan view of the bogie assembly of FIG. 2A.

FIGS. 2 and 3 shows the improved bogie of our invention with out-board 'C' Arms and FIGS. 2A and 3A shows the improved bogie with in-board Arms.

The bogie primarily comprises of an 'H' frame formed by the bolster (2) and a pair of side frames (1*a*, 1*b*). The two side frames are mounted over the axle boxes (4) of the wheels and axles (3*a*, 3*b*). Two C-type arms, one for out-board application (5*a*, 6*a*; 5*b*, 6*b*) or for in-board application (5'*a*, 5'*b*; 6'*a* and (6'*b*) used in pair and comprises the control arms for each axle (3*a*, 3*b*).

The two pairs of 'C' type control arms are connected by two numbers of cross struts (9) by means of pins (10).

Figure 7A:
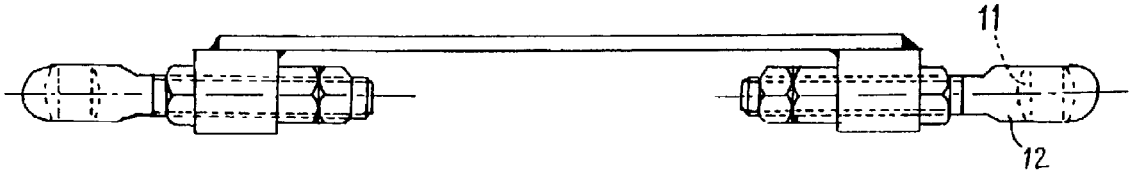
FIG. 7A shows the detail of the strut.
Figure 7B:
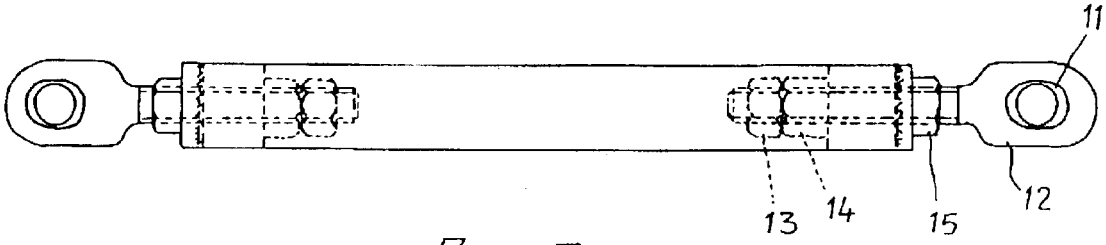
FIG. 7B shows the plan view of the strut as in FIG. 7A.

The details of the cross struts (9) has been illustrated in FIGS. 7A and 7B. The cross struts (9) has been made in such a way that the distance between its eye centres can be made exact to its requirement by the help of its screwed type eye ends (12), nuts (14, 15) and back nuts (13). This arrangement provides improved steering of the axles.

The eye ends (12) have been fitted with spherical bearing (11) to control the level differences of the axles (3*a*, 3*b*) while running on rough rail tracks.

Four numbers of M.S. fabricated adapters (7) are connected with the C-type control arms 5*a*, 6*a*, 5*b*, 6*b* for out-board application and 5'*a*, 6'*a*, 5'*b* and 6'*b* for in-board application by means of welding or rivetting or bolting or huck bolting. The fabricated adapter (7) is provided with a rubber spring as primary suspension which has different stiffness for longitudinal and lateral direction which gives improved riding characteristic of the bogie.

Figure 5:
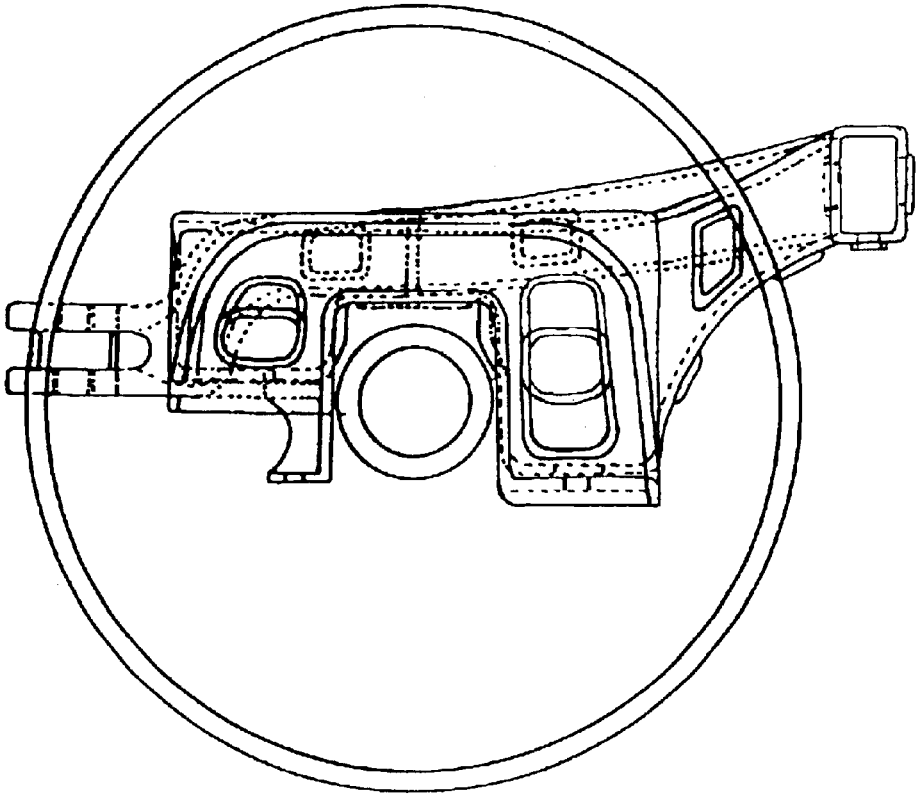
FIG. 5 shows the elevation view of FIG. 4
Figure 4:
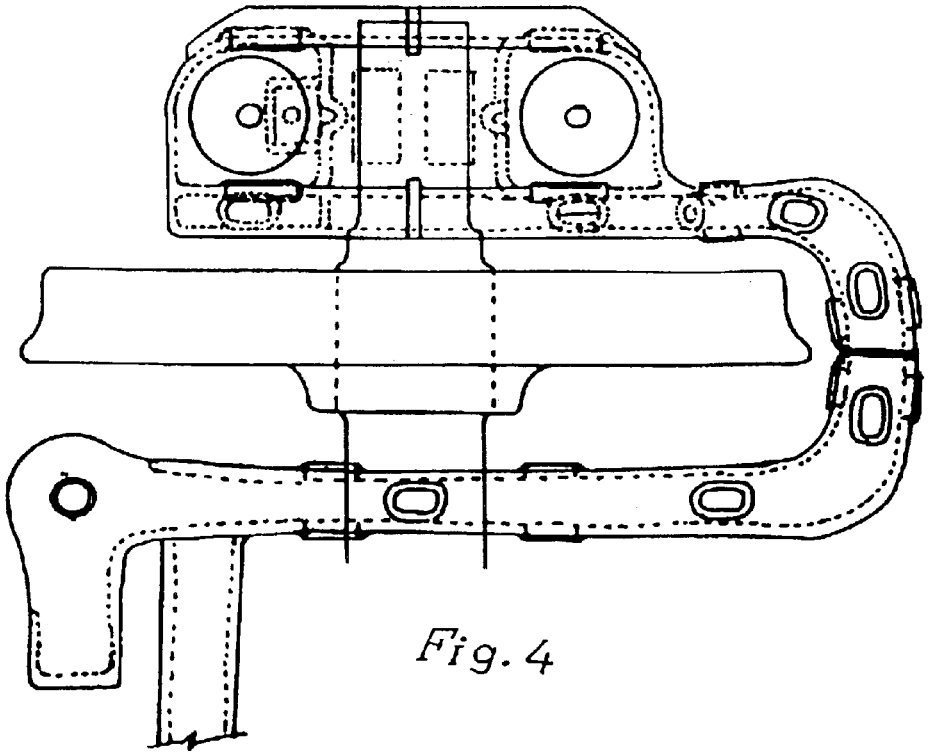
FIG. 4 shows plan view of detail of the control arm for out-board type.
Figure 6A:
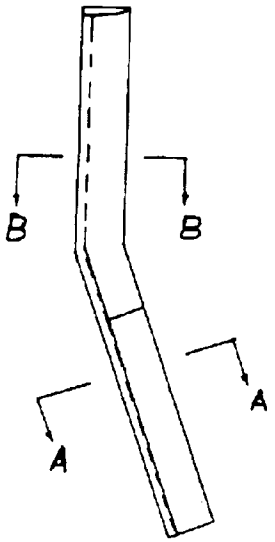
FIGS. 6 & 6A shows constructive detail of the control arm for in-board type.
Figure 6:
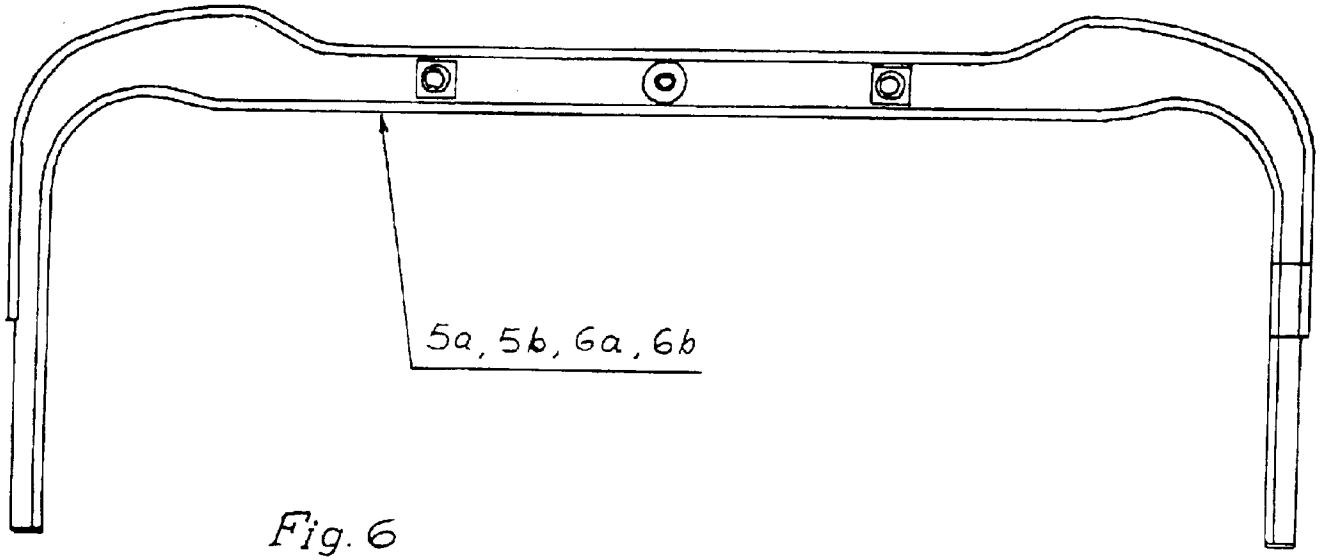
Figure 6B:
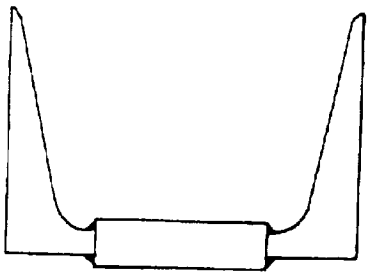
FIG. 6B shows enlarge section B—B of the control arm shown in FIGS. 6 & 6A.
Figure 6C:
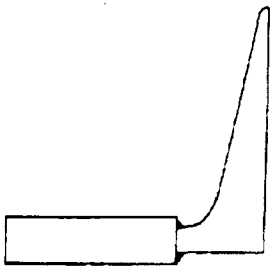
FIG. 6C shows enlarge section A—A of the control arm shown in FIGS. 6 & 6A

The C-type control arms (5*a*, 6*a*; 5*b*, 6*b* and/or 5'*a*, 6'*a*, 5'*b*, 6'*b*) have been illustrated in detail in FIGS. 4 and 5 for out-board type and FIGS. 6, 6A, 6B and 6C for in-board type. These C-arms may be made of cast steel or may be made by other type of fabrication from mild steel.

As shown in FIG. 3A, C-type control arms 5'*a*, 6'*a*; 5'*b*, 6'*b* are arranged according to the in-board version. One C-type arm is located at the top of a bogie assembly and another C-type arm is located at the bottom of the bogie assembly. The C-type arms comprise the control arms for each axle (3*a*, 3*b*).

These design of C-type arms provide a) adequate strength b) less welding in comparison to other design of fabricated type.

c) lesser distortion due to lesser welding, d) lesser weight in comparison to other design The normal invention of C-type arms (5*a*, 6*a*, 5*b*, 6*b*) for out-board type 5'*a*, 6'*a*, 5'*b*, 6'*b* for in-board type and struts (9) is novel and can be retrofitted in existing bogies with minor modification or without any modification irrespective of its wheel diameter, track gauge or make.

The novel features of the invention of C-type control arms (5*a*,6*a*; 5*b*, 6*b* for out-board type and 5'*a*, 6'*a*, 5'*b*, 6'*b* for in-board application) and its cross struts (9) can be easily mounted or dismounted without the necessity of disturbing any major structure of the wagon, either for overhaul repair or replacement.

The novel control arms (5*a*, 5*b*; 6*a*, 6*b*) for out-board application and 5'*a*, 5'*b*, 6'*a* 6'*b* for in-board application) for steering arrangement for bogies/trucks with the angle of wheels (axes) according to the curvature of the track rails i.e. tangentially to the track rails and minimise the wear of wheel flange and rail heads.

The novel control arm (5*a*, 5*b*; 6*a*, 6*b* for out-board application and 5'*a*, 5'*b*, 6'*a*, 6'*b* for in-board application) for self steering arrangement when fitted on bogies shall prevent de-railment of the wagon/freight car while carrying heavy hauls at higher speeds.

The novel control arms (5*a*, 5*b*; 6*a*, 6*b* for out-board application and 5'*a*, 5'*b*, 6'*a*, 6'*b* for in-board application) for self steering arrangement when fitted on bogies shall prevent derailment of the wagon/freight car while carrying heavy hauls at higher speeds.

The novel control arms (5*a*, 5*b*; 6*a*, 6*b* for out-board application and 5'*a*, 5'*b*, 6'*a*, 6'*b* for in-board application) and strut (9) for self steering arrangement shall enable the wagon, when its bogies are being fitted with these to carry/haul substantial amount of freight at a higher speed of 100 k.m.p.h or more and thereby making the haulage of goods more economical.

The novel design of control arms (5*a*, 5*b*; 6*a*, 6*b* for out board Application and 5'*a*, 5'*b*, 6'*a*, 6'*b* for in-board application can be fitted/dismantled quicker than other such system requiring lesser time for repair, overhaul or change.

The novel design has g primary suspension spring of rubber at the axle box adapter which has higher stiffness in the longitudinal direction and lesser stiffness in the lateral direction which attribute a good riding characteristics of the bogies at a higher speed when fitted with this arrangement.

The primary suspension is also carried out alternatively in a dual stage of suspension with a combination of coil springs with rubber spring and/or leaf spring with rubber spring, conical rubber spring and cylindrical rubber spring.

This type of dual suspension ensures high speed stabilities in the empty mode on Wagons with very light construction. The higher deflection as a result of this type of suspension, restrict the unsprung mass of the vehicle system to the mass of the wheel sets only. This is lightest possible unsprung mass that is possible in a rail road vehicle construction and this feature help increasing the life of the track and also subsequently increases the interval time between every two maintenance cycles.

The novel control arm (5*a*, 5*b*; 6*a*, 6*b* for out-board application 5'*a*, 5'*b*, 6'*a*, 6'*b* for in-board application) for self steering arrangement and all its related components can be manufactured indigenously and at low cost.

This novel design permits negotiation of curves and track irregularities without the wheel flange coming into contact with the rail and the few occassion that it does, it will be a trailing contact and not a leading contact.

The invention described hereinabove is in relation to a non-limiting embodiment and as defined by the accompanying claims.

What is claimed:

1. An improved bogie control arm system for steering wheels and axles of 'H-frame' bogies for railway wagons and carriages comprising two pairs of C-shaped control arms for outboard application made of mild steel fabrication or cast steel, each C-shaped control arm surrounding an outboard side of a respective steering wheel with each side of each C-shaped control arm extending past a respective axle of a 'H-frame' bogie, and fabricated adapters connected to each pair of said control arms, said fabricated adapter being configured to connect with a rubber spring as primary suspension, said two pairs of 'C'-shaped control arms being connected to each other by means of cross struts thereby allowing an improved angle of attack while a bogie negotiates a curve or track irregularity.

2. An improved bogie control arm system as claimed in claim 1 wherein the 'H'-frame bogie comprises a pair of side frames and a bolster.

3. An improved bogie control arm system as claimed in claim 2 wherein said side frames are mounted over the axle boxes of the wheels and axles.

4. An improved bogie control arm system as claimed in claim 1, wherein said two pairs of 'C'-shaped control arms are connected by two numbers of cross struts and pins.

5. An improved bogie control arm system as claimed in claim 4 wherein the cross struts are provided with a pair of screwed eye ends and nuts and back nuts for adjustment of said two pairs of C-shaped control arms.

6. An improved bogie control arm system as claimed in claim 5 wherein the eye ends are fitted with spherical bearings to control the level differences of the axles.

7. An improved bogie control arm system as claimed in claim 1 wherein said adapters are configured to connect with the rubber spring as primary suspension having different stiffness for longitudinal and lateral direction for improved riding characteristics of the bogie.

* * * * *